United States Patent [19]

Swerdlow et al.

[11] 4,338,759

[45] Jul. 13, 1982

[54] METHOD OF BUILDING CONSTRUCTION USING CONCRETE REINFORCED WALL MODULES

[75] Inventors: Albert Swerdlow, Oak Park; George Szegedy, Dearborn Heights, both of Mich.

[73] Assignee: Universal Component Systems, Inc., Detroit, Mich.

[21] Appl. No.: 172,576

[22] Filed: Jul. 28, 1980

[51] Int. Cl.[3] ..... E04B 2/68

[52] U.S. Cl. ..... 52/743

[58] Field of Search ..... 52/293, 300, 381, 259, 52/289, 236.8, 236.7, 262, 236.9, 743, 745, 79.11; 264/31, 35

[56] References Cited

U.S. PATENT DOCUMENTS

| | | | |
|---|---|---|---|
| 1,757,077 | 5/1930 | Eiserloh | 52/289 |
| 1,785,067 | 12/1930 | Bemis | 52/258 |
| 2,851,873 | 9/1958 | Nicholson | 52/289 |
| 3,782,049 | 1/1974 | Sachs | 52/595 |
| 4,098,042 | 7/1978 | Sachs | 52/404 |

FOREIGN PATENT DOCUMENTS

| | | | |
|---|---|---|---|
| 2728911 | 9/1978 | Fed. Rep. of Germany | 52/236.8 |
| 931653 | 3/1948 | France | 52/259 |
| 1030985 | 6/1953 | France | 52/289 |
| Ad.60012 | 9/1954 | France | 52/289 |
| 2233459 | 1/1975 | France | 52/259 |

*Primary Examiner*—John E. Murtagh

*Attorney, Agent, or Firm*—Krass, Young & Schivley

[57] ABSTRACT

A method of constructing concrete reinforced structures employs a wall module which includes a plurality of spaced, thin walled tubes and a channel along the upper edge thereof within which concrete may be received to respectively form vertical and horizontal structural supports. A plurality of spaced, vertical support studs disposed on opposite sides of the tubes provide the module with sufficient compressive strength to carry the load of a floor mounted thereabove prior to filling the module with concrete. After the floor has been mounted on the wall modules, concrete is simultaneously poured into the tubes and channel of the module as well as into the space between the module and the floor to provide a continuous concrete connection between the floor and the wall of the resulting structure.

9 Claims, 6 Drawing Figures

METHOD OF BUILDING CONSTRUCTION USING CONCRETE REINFORCED WALL MODULES

TECHNICAL FIELD

The present invention generally relates to prefabricated modules employed to construct buildings, and deals more particularly with a method of constructing buildings using modules of the type having voids therein to receive concrete.

BACKGROUND ART

The use of prefabricated building block components, such as wall modules having voids therein which are filled with concrete during the construction process, is well known in the art as evidenced by U.S. Pat. Nos. 3,782,049 and 4,098,042. Prior art wall modules, such as those disclosed in the patents mentioned above, comprise a pair of spaced wall panels forming the inner and outer wall surfaces of the completed structure which have sandwiched therebetween a plurality of concrete forms in the nature of vertical tubes. The wall panels provide the module with a minimal degree of rigidity until the tubes are later filled with concrete.

These prior art wall modules are provided with an upper horizontally extending channel which is aligned with the channel of adjacent modules and forms a continuous concrete beam when concrete is poured therein when the wall is erected. In constructing a building using prior art modules, individual wall modules were first erected in place on a supporting surface and mechanically interconnected with each other. After steel reinforcement rods were inserted into the tubes, concrete was poured into the tubes and into a lower part of the channel portion of the modules up to the underside of a floor section which was later installed after the initial pour of concrete had cured. The initial pour of concrete formed a continuous concrete beam of partial height in the channel along the upper edge of the wall. It was then necessary to allow the first pour of concrete in the wall module to substantially cure in order to provide the modules with substantial structural strength, since the modules were otherwise too weak to support the loading imposed thereon by the floor thereabove.

After the concrete in the module had cured, a floor section was mounted on an upper edge of each wall module and additional reinforcement rods were inserted in the space between the floor section and the channel of the wall modules. Finally, a second pour of concrete was introduced into the space between the floor section and the channel of the wall modules to complete interconnection of the wall with the floor section. From the foregoing, it can be appreciated that two separate pours of concrete were required in erecting each wall and floor, with a substantial period of delay being necessary between each pour to allow the concrete to cure sufficiently to provide the necessary structural strength demanded by subsequent construction phases. Consequently, the use of prior art wall modules and method of construction were responsible for introducing a substantial construction delay, and was therefore somewhat undesirable in terms of construction economy.

Another program related to the previous construction technique involved the fact that an essentially "cold" joint was formed between the floor section and the walls; this was because separate pours of concrete were required to form the various structure components comprising the connection between the floor and wall. These cold joints naturally reduced the strength and overall structural integrity of the resulting building. The prior art construction technique and wall module also necessitated the use of scaffolding and the like in order to gain access to the concrete receiving openings in the wall modules along the upper edge thereof, since a floor was not present, prior to filling the modules with concrete, upon which construction workers might be supported in a position to have the necessary access to the interior of the modules.

Still a further difficulty with the prior construction technique relates to the fact that each pour of concrete often times required the use of heat applied thereto to aid in curing of the concrete during cold weather. Heretofore, it was necessary to direct a plurality of space heaters or the like against the module walls in order to warm the freshly poured concrete. However, since the floor above the wall being cured had not yet been installed, the area bounded by the walls was open to the environment and the majority of the heat directed onto the walls escaped into the surrounding cold environment. This not only resulted in incomplete or inconsistent curing of the concrete in the modules and increased the overall curing time, but resulted in a considerable waste of energy required to generate the heat.

Accordingly, it is a primary object of the present invention to provide a novel method of construction using a wall module which not only includes voids therein adapted to receive concrete therein but which is capable of supporting the load imposed thereon by a floor mounted thereabove before concrete is introduced into the module.

Another object of the invention is to provide a method of construction which eliminates cold joints between a floor and an associated wall, and provides a continuous concrete connection between the wall and the floor, thereby increasing the overall structural rigidity of the resulting construction.

A still further object of the invention is to provide a construction method as described above which eliminates delay associated with separate pours of concrete, as well as the need for allowing each pour of concrete to cure, by filling the module and interconnection between the floor and wall with concrete in a single pour. As a corollary to the foregoing object, one feature of the invention is to increase the speed of building construction while improving coordination of each construction phase.

A further object of the invention is to provide a novel construction method similar to that described above which reduces the amount of energy used to generate heat employed for curing the concrete while improving the effectiveness of the use of such heat during the curing process. According to another feature of the invention, the walls and floor produced during one construction phase may be erected to form an enclosure within which heat may be confined prior to introducing concrete into the walls.

These and further objects of the invention will be made clear or will become apparent during the course of the following description of the preferred embodiment of the present invention.

DESCRIPTION OF THE INVENTION

In accordance with the present invention, a method of constructing concrete buildings employs a wall module which includes a plurality of spaced, thin walled tubes held in fixed relationship to each other by an upper and lower horizontal frame member. The module further includes a plurality of spaced, vertical support studs laterally positioned on opposite sides of the tube and connected to the upper and lower frame members in order to provide the module with sufficient compressive strength to carry the load of a floor mounted thereabove prior to filling the module with concrete. Upper portions of the module include an elongated channel communicating with each of the tubes and with a space within a floor section mounted thereon. Concrete is simultaneously introduced into the tubes and the channel of the module as well as into the space between the channel and the floor section to form a continuous concrete connection between the floor and the wall using a single pour of concrete. Since the floor is installed above the walls before the concrete is poured, construction workers may stand on the floor to gain access to the channel of the modules for purposes of pouring the concrete. Moreover, the floor and walls form an enclosure which may be heated to thoroughly and uniformly cure the freshly poured concrete.

BRIEF DESCRIPTION OF THE DRAWINGS

In the drawings, which form an integral part of the specification and are to be read in conjunction therewith, and in which like reference numerals are employed to designate identical components in the various views.

DESCRIPTION OF THE PREFERRED EMBODIMENT

Figure 1:
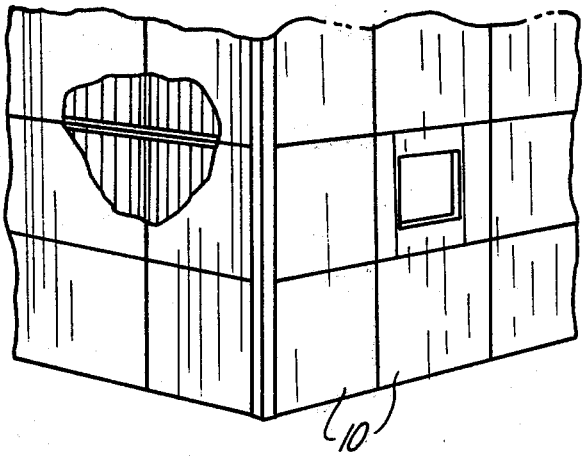
FIG. 1 is a perspective view of a corner of a building structure formed in accordance with the method of the present invention, with a wall section broken away in section to show details of the interior construction.
Figure 2:
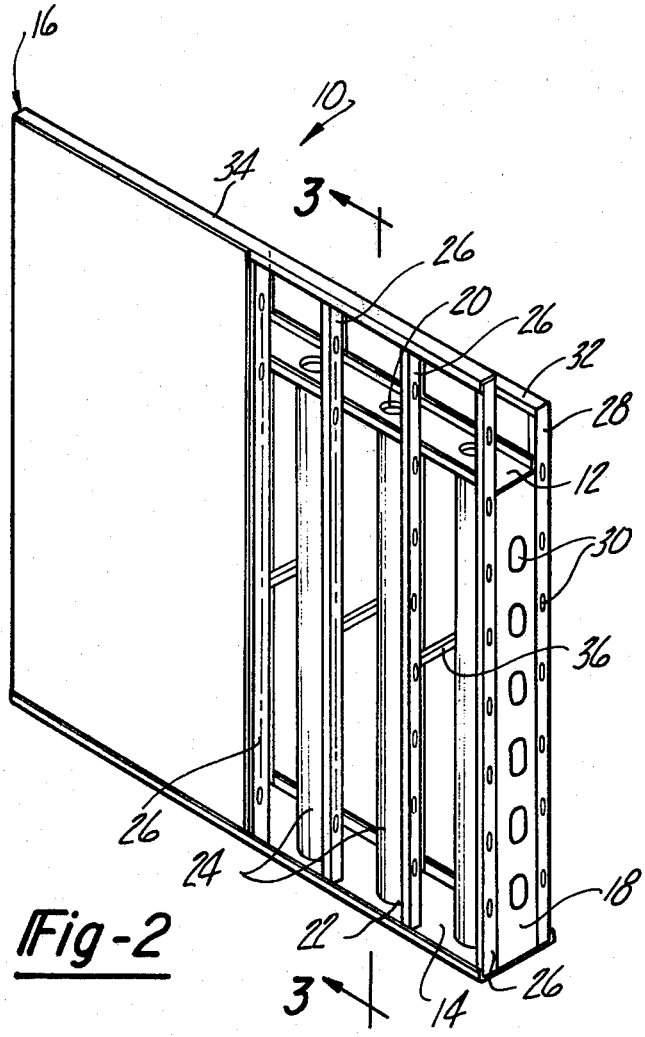
FIG. 2 is a perspective view of one of the modules used in the method of the present invention, parts being broken away for clarity.
Figure 3:
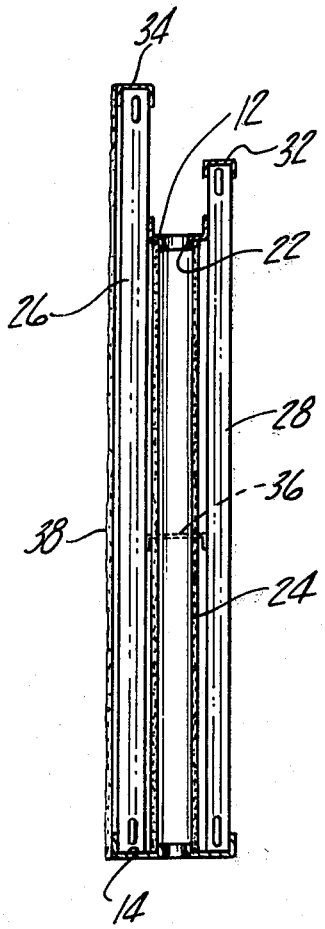
FIG. 3 is a sectional view taken along line 3—3 in FIG. 2.
Figure 4:
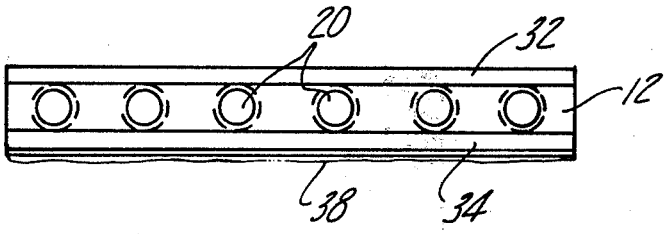
FIG. 4 is a top plan view of the module shown in FIG. 2.
Figure 5:
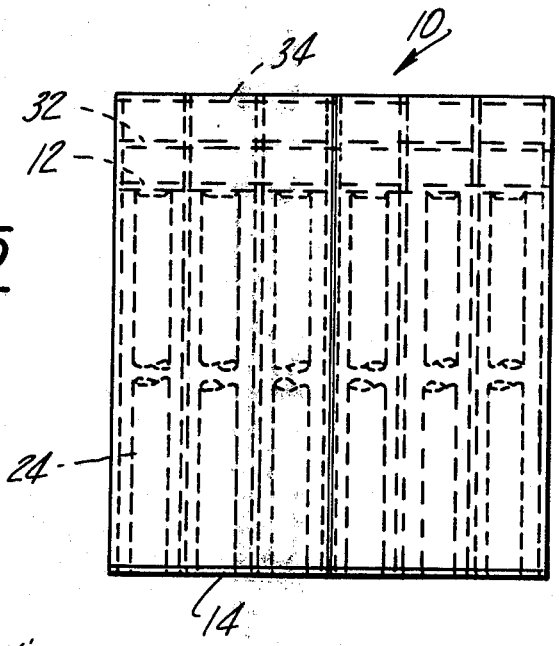
FIG. 5 is a front elevational view of the module shown in FIG. 2.
Figure 6:
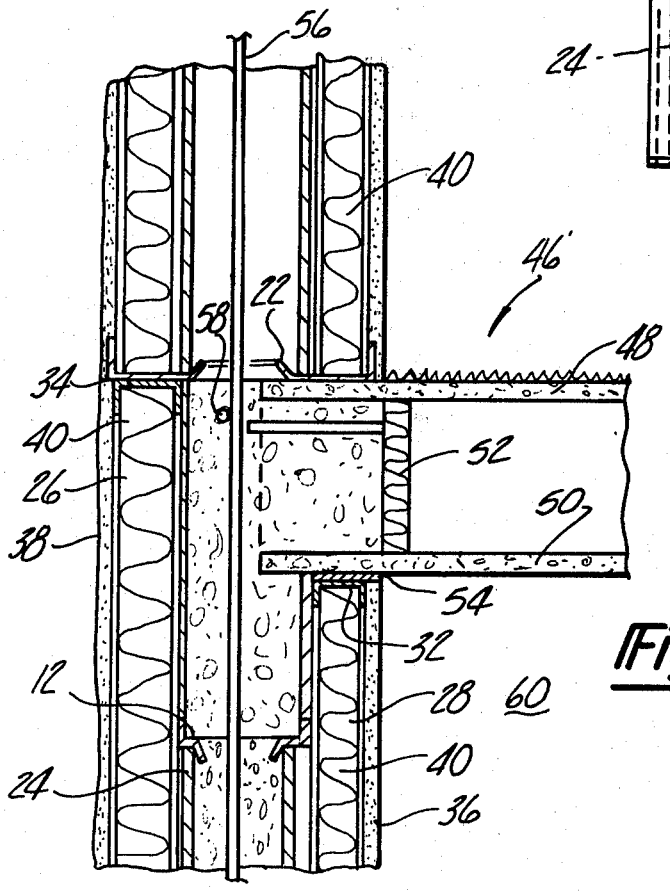
FIG. 6 is a sectional view of a joint formed between a pair of the wall modules and a floor section.

Referring to the drawings, the present invention concerns a method of constructing concrete buildings using a plurality of interconnected wall modules 10. Although the modules 10 shown in the drawings are depicted as being suited for forming exterior walls of a building, it is to be understood that such modules are readily adapted for use as interior walls, as will become later apparent. Additionally, it is to be understood that the wall modules 10 of the present invention may be readily adapted to have windows or the like defined therein, similar to that described in U.S. Pat. No. 4,098,042.

Each of the modules 10 includes an upper and lower horizontally extending, elongate frame member 12 and 14, respectively, which have joined thereto on opposite ends thereof, a pair of vertically extending end walls 16 and 18. Each of the upper and lower horizontal support members 12 and 14 is provided with a plurality of longitudinally spaced, circular apertures 20 therein, preferably formed by punching, which define inwardly turned, tube retaining flanges 22.

The module 10 has an inner core defined by a plurality of thin wall, hollow tubes 24 each of which has the opposite ends thereof essentially open to receive the flanges 22 therewithin. Typically the tubes 24 may be about 6 to 9 inches in inside diameter and may be formed of any self supporting material such as cardboard which has sufficient tensil strength to support the forces imposed thereon by concrete slurry poured within the tubes. The tubes 24 do not perform a structural function in the completed building structure, but rather only act as forms for the pouring of the concrete. In the case of a module intended for use as an exterior wall component, the tubes 24 may typically be disposed on 16 inch centers. The flanges 22 function to retain the tubes 24 between the horizontal support members 12 and 14 in aligned, parallel registration with each other and perpendicular to the upper and lower frame members 12 and 14.

A first set of vertical support members, in the nature of studs 26, each have one end thereof secured to the horizontal support member 14, while upper regions of the studs 26 are secured to the upper horizontal support 12. A second set of parallel vertical support members, or studs 28, also each have one end thereof secured to the horizontal support members 14 while upper regions thereof are secured to upper horizontal support member 12. Studs 26 and 28 are disposed on opposite lateral sides of the tubes 24, in spaced relationship to the latter. Studs 26 and 28 are spaced alternately with respect to tubes 24, and may be typically disposed on 16 inch centers in the case of a module intended for exterior wall use. End walls 16 and 18 as well as studs 26 and 28 may be made of suitable metal stock and are preferably provided with lightening apertures 30 to reduce the overall weight of the module 10. As particularly shown in the drawings, the studs 26 and 28 are of U-shaped cross section and extend parallel to each other as well as to the tubes 24. Both studs 26 and 28 extend vertically above the horizontal support member 12, but studs 26 extend above the upper ends of studs 28 to form a floor receiving notch in the top of the interior side of module 10. The upper ends of studs 28 are each connected to a horizontally extending interior plate 32 which is preferably of U-shaped configuration. Similarly, the upper ends of each of studs 26 are connected with each other by a horizontally extending, exterior plate 34 which is also preferably of U-shaped metal construction. Interior wall modules (not shown) may be formed by constructing the studs 26 and 28 to be of equal length.

Each set of the studs 26 and 28 are arranged in opposed pairs thereof and may be connected intermediate their extremities by transversely extending braces 36 to increase lateral rigidity of the module 10.

As will become later apparent, interior and exterior panels 36 and 38, respectively, may be applied to the interior and exterior faces of the module 10, and more particularly to the studs 26 and 28 in order to enclose the module and thereby form interior and exterior wall surfaces. Additionally, suitable insulation 40 may be interposed between the wall panels 36 and 38 as desired, as well as between the tubes 24 and the panels 36 and 38. Note that although the studs 26 and 28 are shown as being alternately spaced with respect to the tubes 24, the spacing of studs 26 and 28 is not dependent upon the spacing of tubes 24, consequently, the spacing of studs 26 and 28 may be varied as required so as to correspond to the width of the particular panels 36 and 38 employed, or in order to meet loading requirements.

A pair of spaced apart, elongate parallel plates 42 and 44 are interposed between upper portions of the studs 26 and 28 extending above the upper horizontal support member 12 and form, in combination with support member 12, a J-shaped elongate channel which communicates with the interior of each of the tubes 24. Upper horizontal support member 12 may be formed integral with plates 42 and 44 if desired.

The module 10 is particularly suited for carrying out an improved method of constructing a concrete building as will now be described. The first step involved in the improved construction method involves erecting one of the modules 10 on a suitable supporting surface (not shown) such as a footing or foundation. A number of modules are so erected and interconnected along their mutual lateral edges to form a continuous wall. With the wall thus erected, a floor section generally indicated at 46, is mounted on top of the wall. Typically, floor section 46 is of unitary construction and may comprise upper and lower, parallel, precast concrete planks 48 and 50 separated adjacent one end thereof by a horizontally extending wall plug 52 which is disposed between planks 48 and 50 and is spaced inwardly from the exterior extremities thereof. It may be appreciated that other conventional types of floor sections may be successfully employed including a steel joint type or a poured-in-placed reinforced concrete slab.

In any event, the outer edge of the lower plank 50 is positioned on the interior plate 32 so as to be primarily supported by studs 28. A compressible shim 54 may be interposed between the lower plank 50 and interior plate 32 if desired. With the floor section 46 thusly installed, the exterior edges of the upper and lower planks 48 and 50 are spaced inwardly from studs 26 and the outer panel 38 so as to define an elongate slot communicating with the J-shaped channel in the upper portions of each of the modules 10. Vertically extending steel reinforcement rods 56 are then inserted into the interior of tubes 24 and a single pour of flowable concrete is introduced through the longitudinal slot between the floor section 46 and studs 26 into the J-shaped channel. Concrete entering the J-shaped channel flows into the interior of tubes 24 and eventually begins to fill the bottom of the channel. As the channel is being filled, horizontal steel reinforcement rods 58 are inserted into the channel or between adjacent ones of the floor sections 46. As concrete continues to flow into the channel, the lower portion thereof between plate 42 and 44 is filled to provide a horizontally extending beam running the entire length of the wall. Finally, concrete flows into the space bounded by upper portions of the plate 44, upper and lower planks 48 and 50 and plug 52 until the upper level of concrete is flush with the upper edge of plate 38 and upper plank 48.

During the single pour of the concrete, workman performing the pouring operation may position themselves and their equipment on the upper plank 48 so as to have convenient access to the longitudinal slot between the floor section 46 and modules 10. It may also be appreciated from the foregoing description, that a continuous volume of concrete extends through the tubes 24, J-shaped channel at the top of the modules 10 and the space between the modules 10 and the floor section 46, to define a continuous structural connection between these building components which is totally free of concrete joints.

At this point in the construction procedure, the single pour of concrete is allowed to set and cure in order to provide the wall and floor section 46 with the additional structural strength to support additional floors and walls thereon. In order to hasten and assure complete effective curing of the concrete during cold weather, heat is applied to the modules 10 preferably from the interior side thereof. Recalling now that the entire wall of one story of the building as well as the floor thereabove have already been constructed, it may be appreciated that an enclosure 60 defined by the module 10 and floor section 46 is provided within which heat may be introduced by any suitable means in order to warm the freshly poured concrete within each of the modules 10. By virtue of the enclosure 60, the air warmed adjacent the interior sides of the modules 10 is prevented from escaping into the atmosphere; consequently, less energy is needed to impart the desired amount of heat to the concrete. Moreover, since all of the air within the enclosure 60 is at approximately the same temperature, heat is applied essentially uniformly to all of the modules 10 in a manner which avoids "cold spots" and may be easily controlled with regard to temperature.

After the concrete has been cured, another module **10*a* and associated floor section (not shown) may be mounted on top of module 10 and floor section 46 in the manner previously described in order to construct additional stories of the building. Insulation 40 may be installed within the modules 10 and 10*a*, and the wall panels 36 and 38 may then be secured directly to the studs 26 and 28**.

In view of the foregoing it is apparent that the wall module 10 comprises an inner structural core consisting of concrete and a surrounding structural grid which initially serves to support a floor mounted thereonabove but later serves only to provide framework to which exterior and interior wall panels may be applied. Additionally, it may be appreciated that a novel method of constructing a cast-in-place concrete structure is disclosed using prefabricated wall modules which comprises the steps of: erecting the wall module to form a wall; placing a floor on top of the wall; supporting the floor using the wall; and, then, introducing flowable concrete simultaneously into the wall module and into the floor to form a continuous concrete connection between the wall and the floor. Further, it is apparent that the step of supporting the floor using the wall is carried out by positioning a plurality of vertically extending support studs in weight bearing relationship between a supporting surface and an edge of the floor section. Thus, it is clear that the method of construction described above not only provide for the reliable accomplishment of the objects of the invention but does so in a particularly effective and economical manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

Having thus described the invention, what is claimed is:

1. A method of constructing a multi-story, cast-in-place concrete building without the need for superstructure supports, comprising the steps of:

(A) forming a first plurality of wall modules each adapted to receive structurally supporting concrete therein by (1) connecting the opposite extremities of each of a plurality of elongate, concrete receptacles to a pair of spaced apart, generally parallel horizontal support members respectively, (2) connecting the opposite extremities of each of a plurality of elongate, vertical support members to said horizontal support members respectively at spaced intervals along said horizontal support members, (3) forming a U-shaped channel along one of said horizontal support members;

(B) erecting said first plurality of wall modules to form a wall defining a first story of said building;

(C) placing a floor on said wall;

(D) supporting said floor using said vertical support members; and (E) then, following step (D), forming a plurality of structurally supporting vertical and horizontal concrete beams substantially simultaneously in said wall by introducing flowable uncured concrete into said receptacles and said channels of said first plurality of wall modules.

2. The method of claim 1, including the step of curing the concrete introduced in step (E) by introducing heat into the area enclosed by said wall and said floor.

3. The method of claim 1 including the step of introducing continuous, rigid reinforcement rods into the concrete receptacles.

4. A method of constructing a cast-in-place concrete building without the need for a superstructure, comprising the steps of:

(A) forming a plurality of relatively light weight wall modules by (1) connecting the opposite extremities of each of a plurality of elongate concrete receptacles to a pair of spaced apart horizontal support members respectively, (2) securing first and second pluralities of spaced apart weight bearing vertical support members respectively on opposite sides of said receptacles;

(B) erecting said wall modules to define a wall of said building;

(C) placing a floor on said wall;

(D) supporting said floor using at least one of said first and second plurality of vertical support members;

(E) then, introducing uncured flowable concrete into said receptacles.

5. The method of claim 4, wherein step (A) (2) is performed by fastening the opposite extremities of said first and second pluralities of members to said horizontal support members respectively.

6. The method of claim 4, including the step of:

(F) forming a horizontal channel integral with each of said wall modules.

7. The method of claim 6, wherein step (F) is performed by utilizing one of said horizontal support members as the bottom of said channel and utilizing the upper extremities of said vertical support members to support the sides of said channel.

8. The method of claim 6, wherein step (F) is performed by placing a pair of panel members respectively into abutment with the opposing sides of said first and second pluralities of vertical support members.

9. The method of claim 6, wherein step (E) is performed by pouring said concrete substantially simultaneously into said receptacles and said channel and laterally into portions of said floor.

* * * * *